US007232157B2

(12) United States Patent
Amaral

(10) Patent No.: US 7,232,157 B2
(45) Date of Patent: Jun. 19, 2007

(54) BLANK MODULAR BOOK TO BE ENCLOSED IN AN ARTISTIC CASE TO BE FILLED OUT IN WRITING BY THE MEMBERS OF SUCCESSIVE GENERATIONS OF THE SAME FAMILY DURING A LONG TIME

(76) Inventor: Guido Amaral, Rua Luis Alberto Martins 190, 05530-030 São Paulo (BR)

( * ) Notice: Subject to any disclaimer, the term of this patent is extended or adjusted under 35 U.S.C. 154(b) by 399 days.

(21) Appl. No.: 10/481,305

(22) PCT Filed: Jun. 17, 2002

(86) PCT No.: PCT/BR02/00084

§ 371 (c)(1),
(2), (4) Date: Dec. 17, 2003

(87) PCT Pub. No.: WO02/102600

PCT Pub. Date: Dec. 27, 2002

(65) Prior Publication Data

US 2004/0262907 A1 Dec. 30, 2004

(30) Foreign Application Priority Data

Jun. 19, 2001 (BR) ..... 0103672

(51) Int. Cl.
*B42D 1/00* (2006.01)
*B42D 5/00* (2006.01)

(52) U.S. Cl. ..... 281/38; 281/15.1; 281/19.1; 281/20; 281/22; 206/424; 206/575; 206/457; 434/154

(58) Field of Classification Search ..... 281/15.1, 281/19.1, 20, 22, 38; 206/424, 575, 457; 434/154
See application file for complete search history.

(56) References Cited

U.S. PATENT DOCUMENTS 2,018,826 A 10/1935 Zell (Continued)

FOREIGN PATENT DOCUMENTS

GB 997108 6/1965

*Primary Examiner*—Monica Carter
*Assistant Examiner*—Mark Henderson
(74) *Attorney, Agent, or Firm*—Dorsey & Whitney LLP

(57) ABSTRACT

Patent for a blank modular book (FIG. 1), the modules being distinguished by tags (1), each having the same number of pages, designed to be filled in by the members of each generation of the same Family, whatever they may want to write, each module being provided with transparent plastic bags for keeping photographs and documents, thus, in view of its long life extending for many centuries and even millennia, the book will be a material sound link in the Family, and can even result in the formation of a true "Clan" and, in view of having this characteristic of a very long life, it requires the protection of a highly resistant case (FIG. 8) which, besides enclosing the book, will have a number of small closed compartments (13) provided with port-holes (16), besides a removable metal plate (11) to receive low relief engravings on its two faces as time goes by, what will result in the construction of a kind of "family tree" of the Family and, finally, since the case is aesthetically refined the whole assembly is also designed to be an object of adornment for the house (FIG. 8).

1 Claim, 8 Drawing Sheets

U.S. PATENT DOCUMENTS

| | | | | | |
|---|---|---|---|---|---|
| 3,314,464 | A | | 4/1967 | Veilleux | |
| 4,467,920 | A | * | 8/1984 | Smith | 206/457 |
| 4,470,488 | A | * | 9/1984 | Broussard | 190/16 |
| 4,703,854 | A | * | 11/1987 | Cline | 206/424 |
| 4,802,619 | A | * | 2/1989 | Laido | 229/125.19 |
| 4,954,003 | A | * | 9/1990 | Shea | 402/79 |
| 4,974,983 | A | * | 12/1990 | Givati | 402/80 R |
| 5,022,527 | A | * | 6/1991 | Braeutigam | 206/522 |
| 5,048,900 | A | * | 9/1991 | Nunn | 312/114 |
| 5,054,816 | A | * | 10/1991 | Rosengarten | 281/42 |
| 5,129,522 | A | * | 7/1992 | Druskoczi | 206/574 |
| 5,353,925 | A | * | 10/1994 | Lennen et al. | 206/204 |
| D385,781 | S | * | 11/1997 | Levine et al. | D9/737 |
| 5,712,005 | A | * | 1/1998 | Monn | 428/34.1 |
| 6,010,000 | A | * | 1/2000 | Tran | 206/424 |
| 6,029,820 | A | * | 2/2000 | Brown et al. | 206/503 |
| D449,853 | S | * | 10/2001 | Myers | D19/26 |
| 6,308,831 | B1 | * | 10/2001 | Saxe et al. | 206/449 |
| 6,447,079 | B1 | * | 9/2002 | Irwin | 312/118 |
| 6,926,307 | B2 | * | 8/2005 | Mathews-Lingen | 281/22 |
| 2003/0011189 | A1 | * | 1/2003 | Swoboda | 281/22 |

* cited by examiner

BLANK MODULAR BOOK TO BE ENCLOSED IN AN ARTISTIC CASE TO BE FILLED OUT IN WRITING BY THE MEMBERS OF SUCCESSIVE GENERATIONS OF THE SAME FAMILY DURING A LONG TIME

This patent application is the National Stage of International Application No. PCT/BR02/00084, filed Jun. 17, 2002, which claims benefit of Brazilian patent application PI 0103672-6, filed Jun. 19, 2001.

The object of the present invention is a new article to be manufactured and commercialized, said article comprising a blank book that, in view of the purpose it is designed for, is provided with large dimensions both in the length and width and thickness.

The book is divided into modules, each having the same number of pages, except for the first module whose number of pages, for the reason mentioned above, is doubled. The modules are distinguished from one another by colored tags attached to the edges, which tags can be seen when the book is open, and are also visible when the book is closed, since they make out a single assembly. The tags may have several colors, but all the pages of each module will have tags of the same color. The expression "1st GENERATION" will be written on the tags of the first module, the expression" 2nd GENERATION" on those of the second module, and so on, until the end.

The division of the book into modules is important because each module is to be filled in, written and/or scanned by the members of each generation of the same Family, as messages, opinions, suggestions, guidelines and even commitments, signatures, reports on important facts related to his/her Family, native town, native country and the world, so that the next generations can get acquainted to.

Obviously it can used at will, for example, a certain member of the family, when a child, may write in his/her parents and grandparents' (previous generations) modules, in the modules of his/her own generation, and then later as a parent and grandparent in the next modules. The first module will have a double size, so that the writer can report what he/she knows about the previous generations.

As a complement, the book will be started, as a preface, by a brief printed disclosure of the creation and purposes thereof, the pages will be numbered, the name of an important person or a historical fact will be randomly cited in the footnote, but each module will be provided with transparent plastic bags having the same size as that of the pages, wherein photographs and documents can be kept.

As a further complement, but now of the object as a whole, and because it is necessary since the book will last for a long period of hundreds of years, it is recommended that it shall be kept protected in a bookshelf or another place, enclosed in a highly resistant finely finished almost air-tight case which is bigger than the book both in the length and width and height, provided with internal partitions so that, when the book is conditioned in the center of the case (an enclosure provided with handles is required to insert and remove same from its niche in the case), small closed compartments provided with a porthole for keeping a number of small objects will be formed between same and the edges, as well as in its cover. To exemplify, such compartments could be used for keeping, among others things, electronic devices containing recorded sound and image that already exist nowadays and are becoming smaller as time goes by. Thus, family parties or even important public events, after being recorded, could be conveniently passed on to the next generations. We also suggest that the wedding rings of the "authors" be kept therein after they have died.

Another important complement will be a removable metal plate having rectangular partitions and lodged in the inner part of the case cover, designed to receive low relief engravings in both faces so that a kind of "family tree" of the Family can be constructed as time goes by, one rectangle for each generation. Said plate should have the same length and width as those of the book and, when removed, should provide access to a large chamber designed for keeping objects, documents, coat-of-arms, etc.

A further purpose of this book of the Family or Generations, within its artistic case, besides constituting a special object that will establish a material and sound link among the successive generations of a Family, is to become a piece of adornment for the house, thus deserving a special and privileged place to be displayed in the house.

This is, therefore, the main inventive concept of the object now in question, that is, a vehicle to be offered to a Family to pass on to the successive generations what each of its members wishes, so that a Clan can result therefrom as time goes by. (To exemplify, two millennia embody about seventy generations). Also, since it is an object designed to last for a very long time, it requires a case as a protection therefor, the assembly constituting a piece of both esteem for the Family and adornment for the house.

Thus, it is not a published book or a book to be published in the sense of a "literary work of art" (item IV of article 10 of Law 9279) because it is not a book containing a plot that has already been written, but designed to be written by the members of successive generations as time goes by, containing remarks that will not have any connection or sequence with one another, but only varied information accompanied by photographs and documents for the purpose of informing the descendants.

Also, it is not an "Industrial Design", that is, a new ornamental plastic form of lines and colors (article 95 of Law 9279) of a "Family album", for the concept of "album" is related to something like a book but generally having thick pages mainly designed to receive photographs and wherein at most the dates and names of people or places photographed appear under the photographs.

Also, it is neither a "dairy" nor an "appointment book", both as personal books and booknotes, the first one designed for remarks, generally those considered to be intimate and not destined to foreign people, and the second one mainly designed for noting down appointments also not destined to foreign people.

Therefore, the assembly described above which is the object of the present patent application constitutes a novelty, there being nothing that it is similar or can be compared thereto.

The accompanying figures show the details of the whole assembly (book, case, etc.) object of the present invention, wherein.

Figure 1:
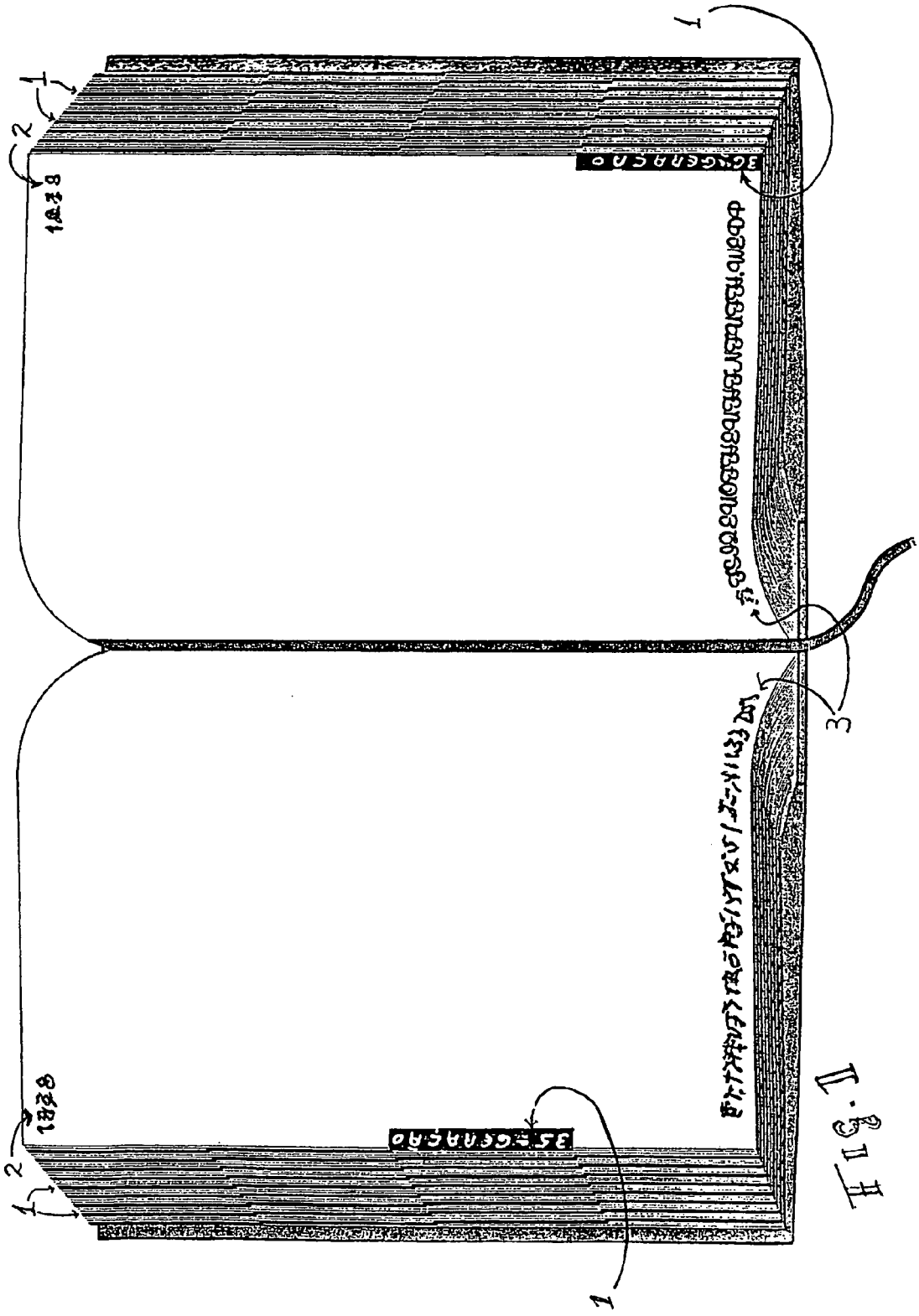
FIG. 1 shows the book open.
Figure 2:
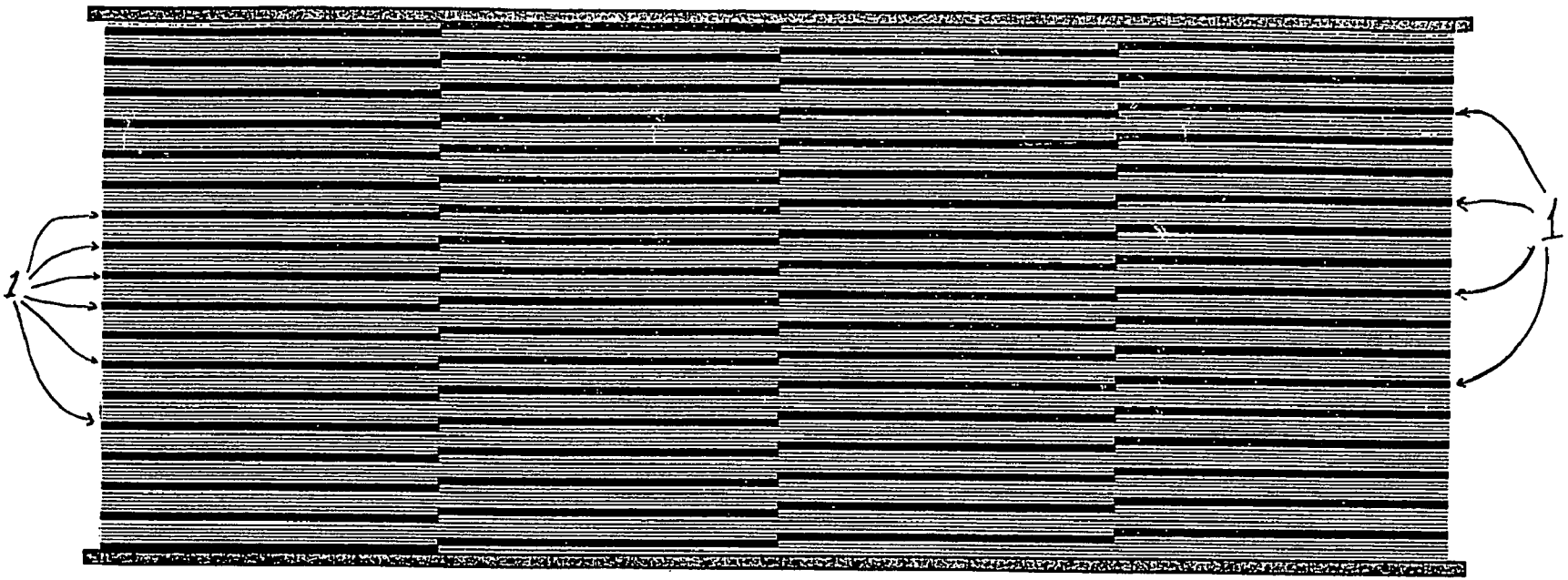
FIG. 2 shows the book closed.
Figure 3:
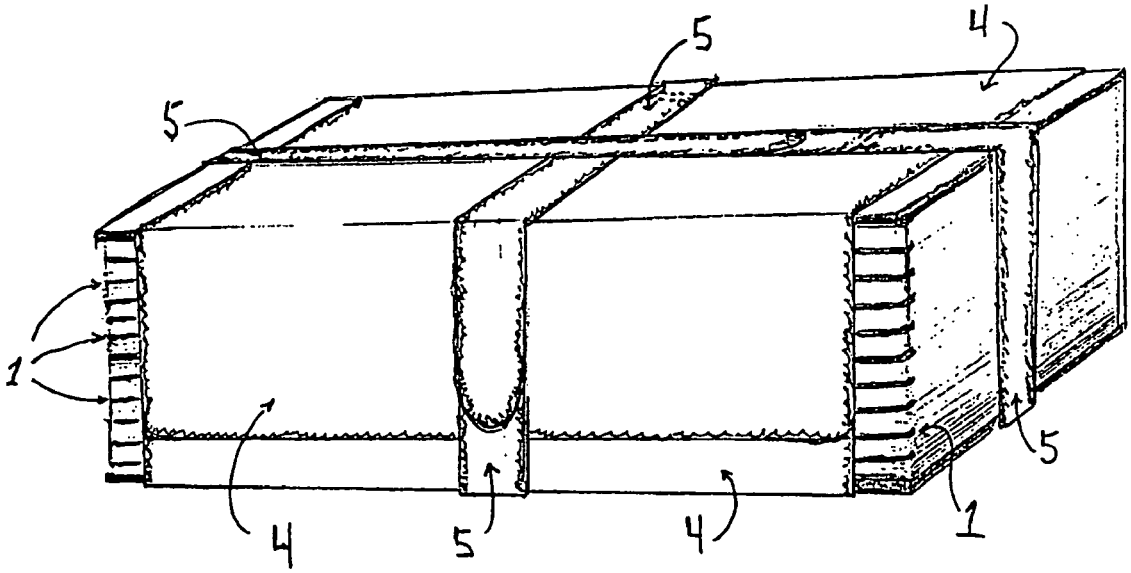
FIG. 3 shows the book closed plus the enclosure and handles.

According to the illustrations in the above mentioned figures, the modules of the book can be distinguished from one another by colored tags attached to the pages, which tags can be seen when the book 1 is open, and also visible when the book 1 is closed. The pages 2 will be numbered and random citations of important persons or historical facts 3 will be written in the footnotes. The enclosure 4 held by the handles 5 is required so that the book can be inserted into and removed from its niche 6 in the case.

The case will have a lock 7, its two parts 8 having the same height and opening by 180° through hinges 9, provided with holders 10 to facilitate the lifting and transportation thereof.

Figure 4:
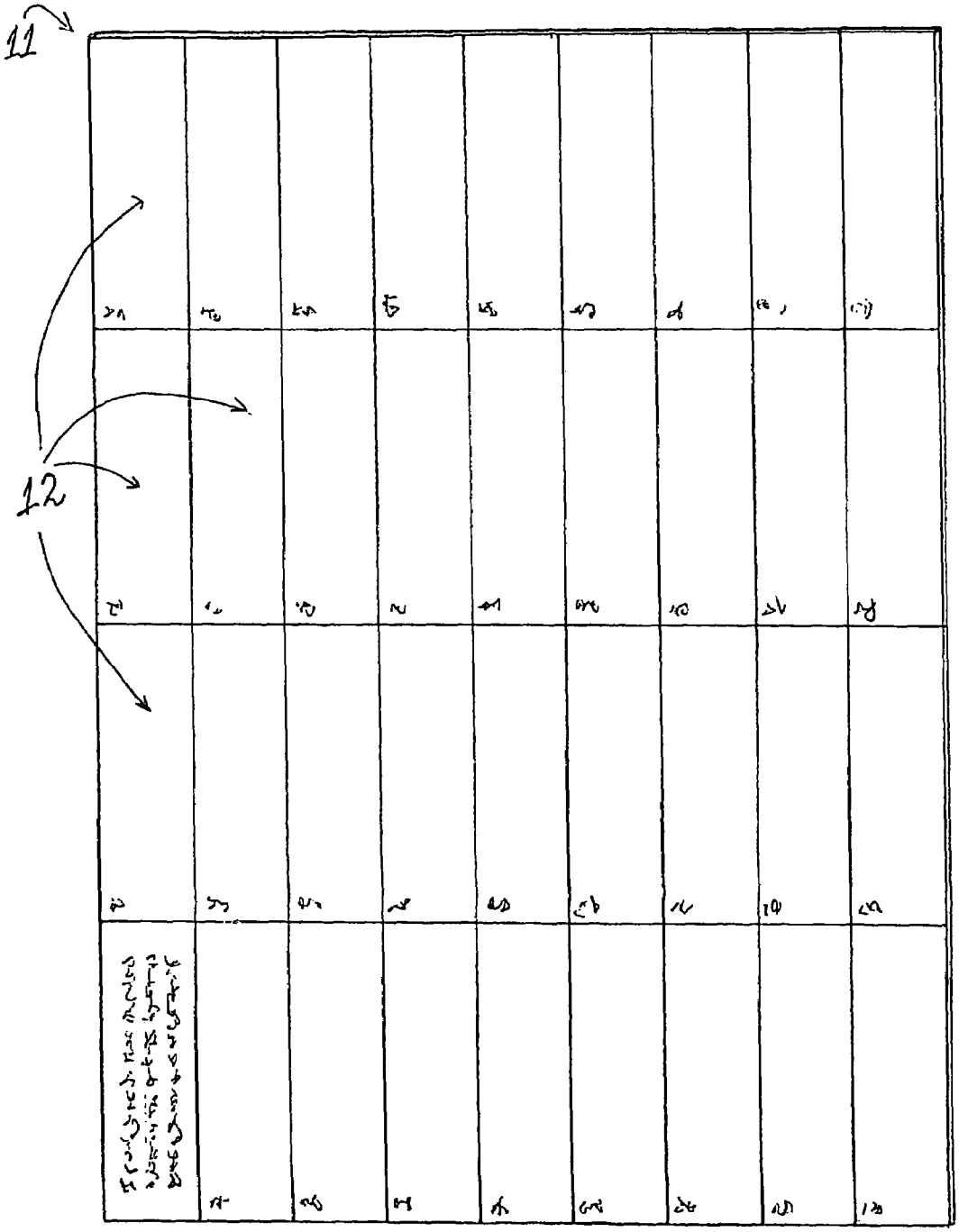
FIG. 4 shows the metallic plate having rectangular partitions.
Figure 5:
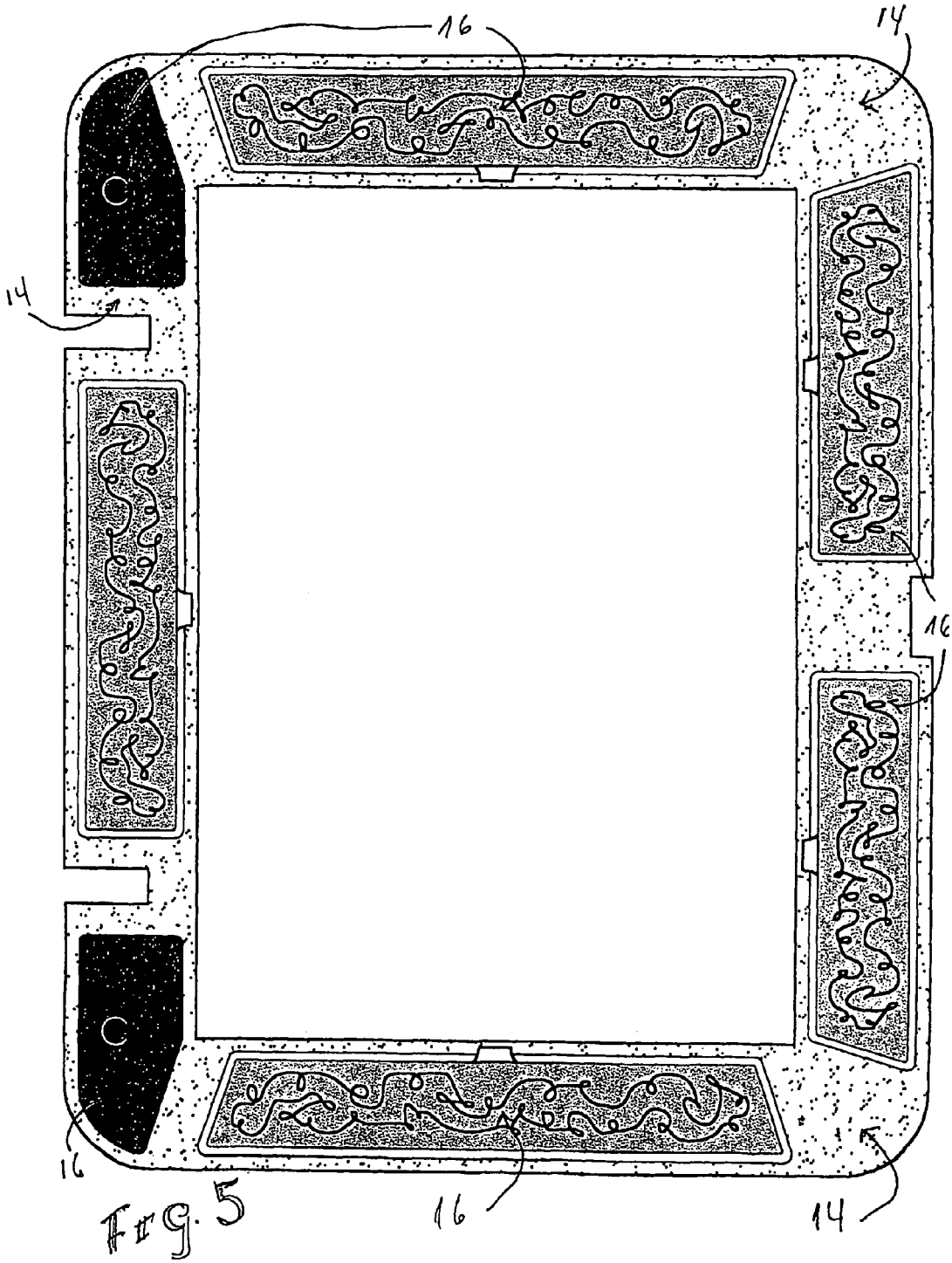
FIG. 5 shows the piece for closing the small compartments of the case cover, with the portholes and plate supports.
Figure 6:
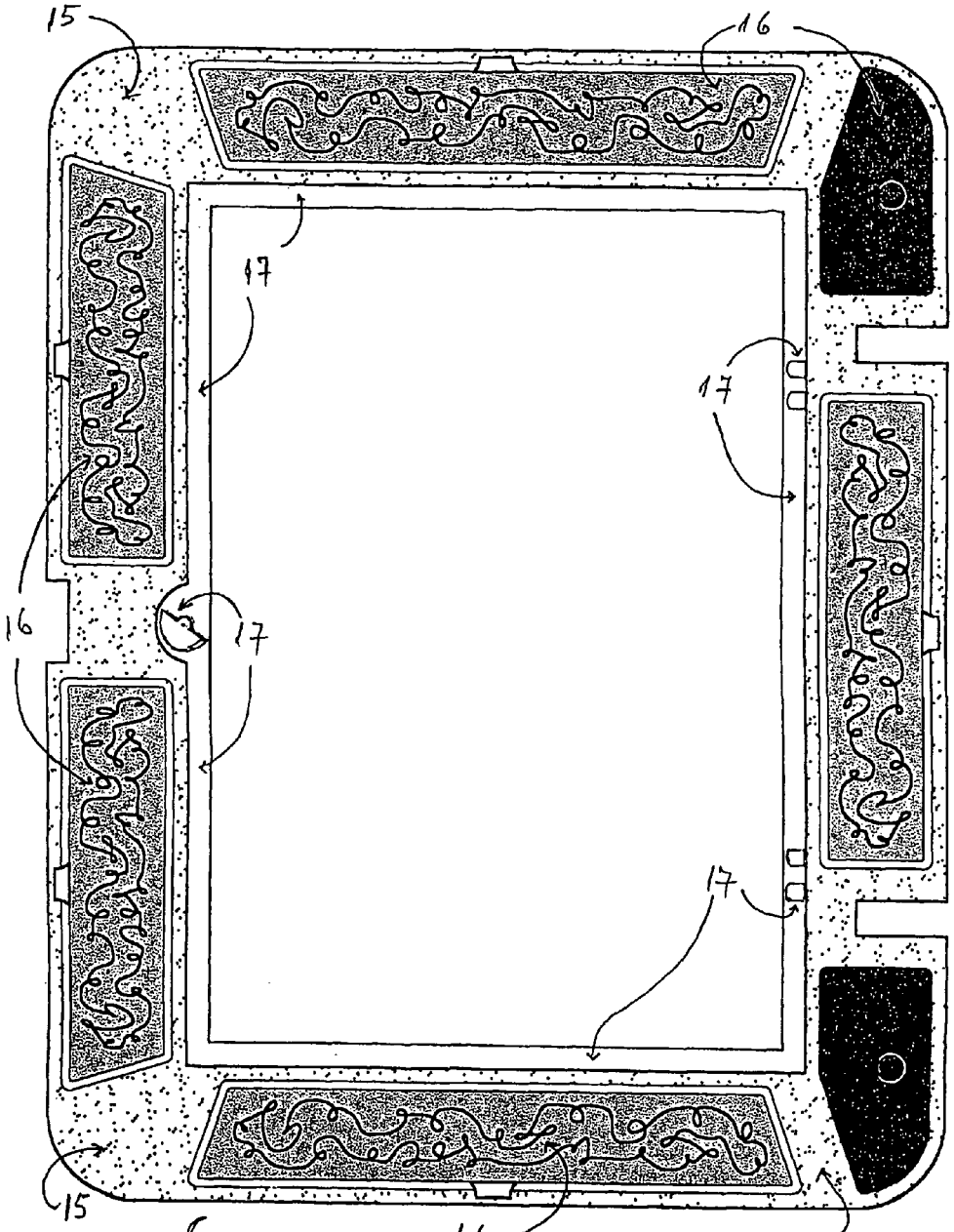
FIG. 6 shows the piece for closing the small compartments of the case cover, with the portholes and plate supports.

FIG. 4 shows the metal plate 11 with its rectangle-shaped partition 12.

The side compartments 13 will be closed as a single part, the main part of the case being directed upward 14 and that of the cover being directed downward 15.

Figure 7:
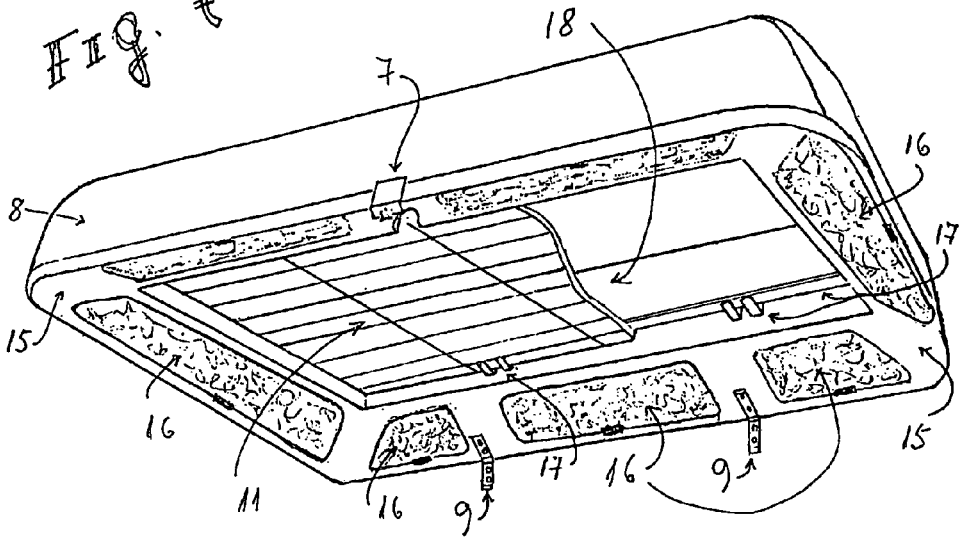
FIG. 7 shows a partially exploded perspective view of the case.
Figure 7:
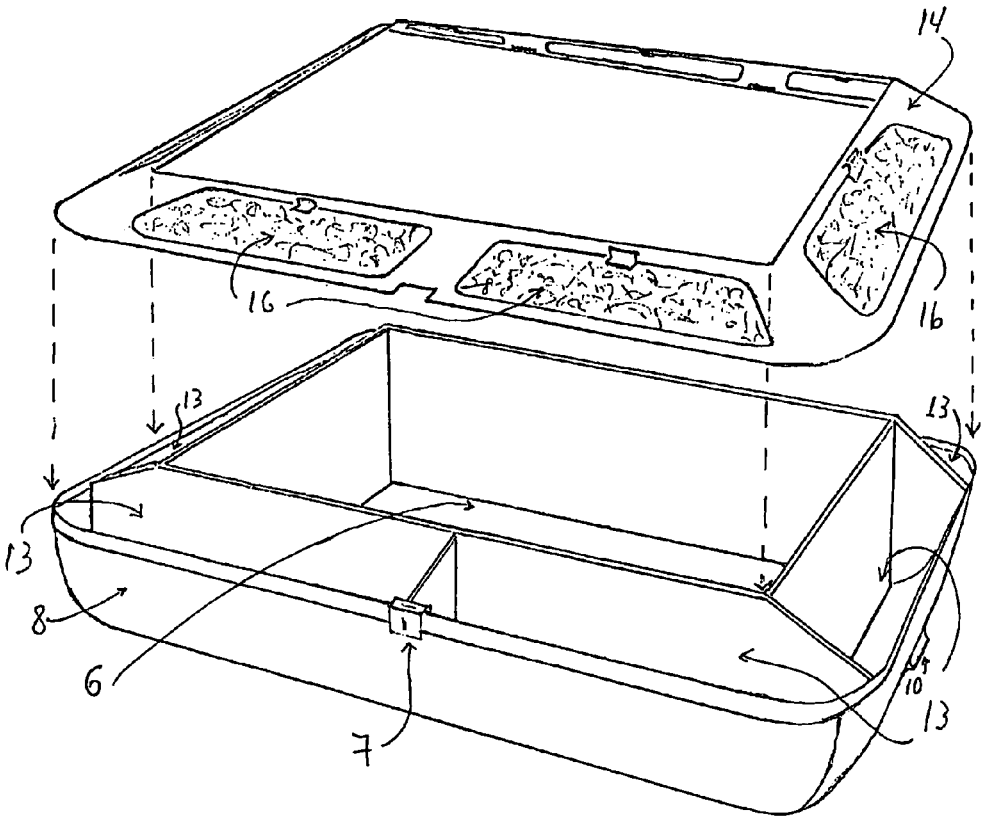
Figure 8:
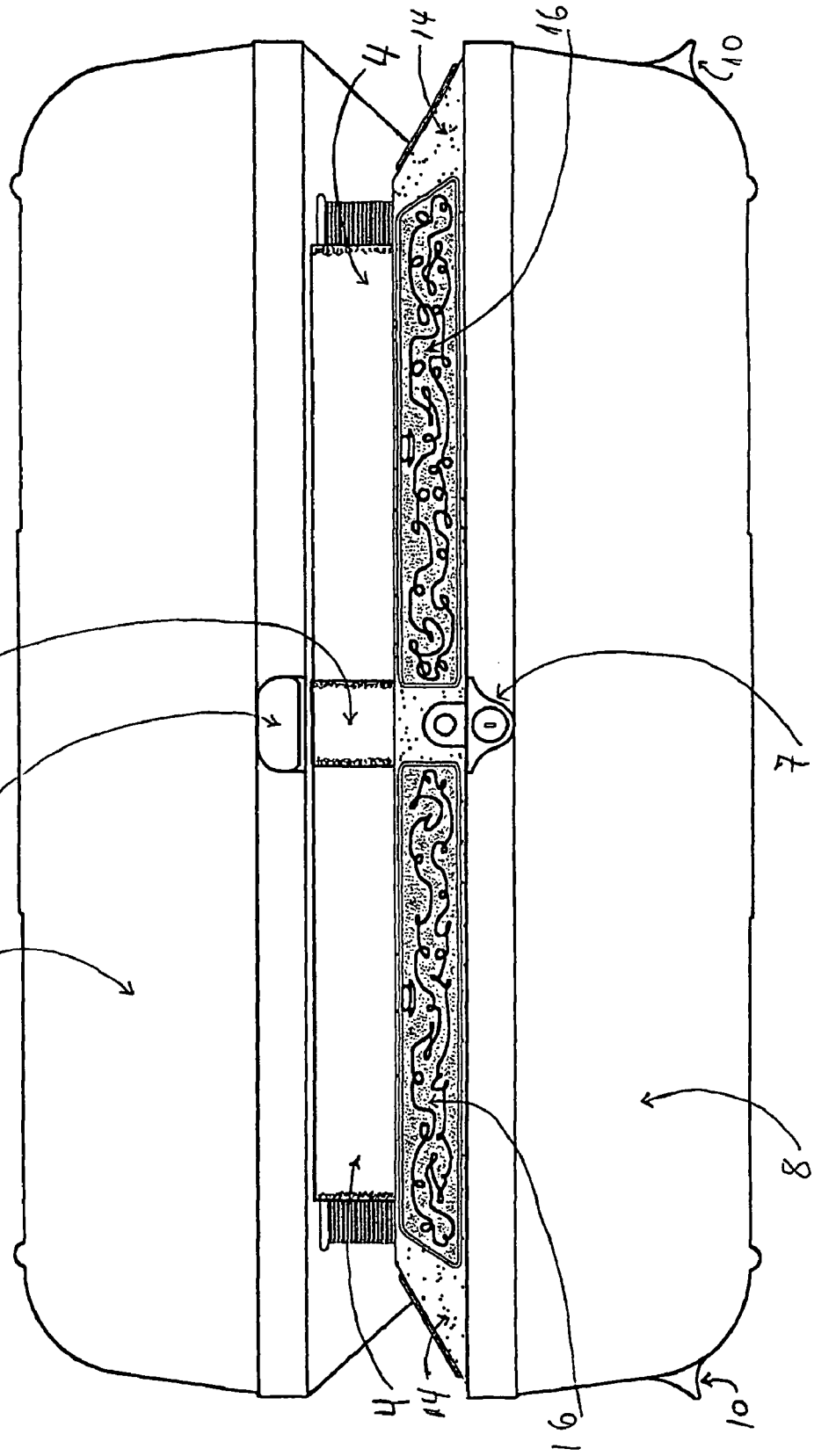
FIG. 8 shows the assembled construction, with the case partially opened.

In FIG. 7 part 15 is already fit in its place in the cover. The portholes 16 for providing access to the small compartments 13 are already fit in their place in parts 14 and 15.

In FIG. 7 the metal plate 11 provided with supports 17 therefor is already fit in its place but the drawing is cut so that the large chamber 18 can be seen underneath same.

Obviously the book can be constructed with different numbers of modules to encompass different numbers of generations for many centuries and even millennia.

The invention claimed is:

1. A blank modular book enclosed in an artistic case to be filled out in writing by members of successive generations of a same family during a long time, comprising a blank book (1) having numbered pages (2) footnotes of which contain random citations of names of important persons or historical facts (3), the book (1) having large dimensions and being divided into modules each one having the same number of pages, said modules being distinguished from one another by colored tags attached to all pages (2) which tags can be seen in order to identify same even when the book (1) is closed, characterized in that the members of successive generations of the same family can write thereon for a long period of many centuries and even constituting a system capable of creating a material and sound link in the family as time goes by resulting in a formation of a clan, wherein each generation can register varied information, remarks, messages and so on in each module so that next generations can get acquainted to, initial writers being provided with a double number of pages to report what is known of previous generations, all tags containing the information about the generation the module is derived, each module also being provided with special transparent plastic bags for keeping photographs and documents and, in view of its long life, the book (1) will require a protection by means of an enclosure (4) provided with handles (5), lodged in a niche (6) of a fine reinforced case (8) provided with a lock (7), holders (10) and having two parts of a same height which are pivoted by hinges (9), a removable metal plate (11) provided with rectangular partitions (12) designed to receive low relief engravings for the formation of a family tree, said plate (11) being lodged and supported by supports (17) in a case cover (8) and a large chamber (18) underneath same, said case (8) being larger than the book (1) and further provided with side compartments (13) extending directed upwardly from its base, said compartments (13) being closed by portholes (16).

* * * * *